United States Patent [19]

Miller

[11] Patent Number: 4,661,664

[45] Date of Patent: Apr. 28, 1987

[54] HIGH SENSITIVITY MAT SWITCH

[76] Inventor: Norman K. Miller, Concord Industrial Park, Concordville, Pa. 19331

[21] Appl. No.: 812,075

[22] Filed: Dec. 23, 1985

[51] Int. Cl.[4] ..... H01H 13/70

[52] U.S. Cl. ..... 200/86 R; 200/85 A; 340/666

[58] Field of Search ..... 200/85 R, 85 A, 86 R, 200/86 A, 86.5, 159 B, 5 A, 292, 333, 302; 340/365 A, 666

[56] References Cited

U.S. PATENT DOCUMENTS

| | | | |
|---|---|---|---|
| 4,090,045 | 5/1978 | Marsh | 200/86 R |
| 4,137,116 | 1/1979 | Miller | 200/85 A |
| 4,200,777 | 4/1980 | Miller | 200/85 A |
| 4,349,710 | 9/1982 | Miller | 200/61.43 |
| 4,362,911 | 12/1982 | Sears | 200/86 R |
| 4,396,814 | 8/1983 | Miller | 200/61.43 |

*Primary Examiner*—G. P. Tolin

*Attorney, Agent, or Firm*—Robert K. Youtie

[57] ABSTRACT

A mat switch of high sensitivity including outer sheets which may be relatively stiff for wear resistance, an intermediate open work spacer sheet, conductive sheets interposed between the outer sheets on opposite sides of the spacer sheet for contacting on flexure through the space sheet, and a compressible deflection sheet interposed between one conductive sheet and the adjacent outer sheet, the deflection sheet being resiliently compressible for protrusion through the spacer sheet to contact the conductor sheets upon movement of the outer sheets in parallelism toward each other.

9 Claims, 3 Drawing Figures

FIG. 1
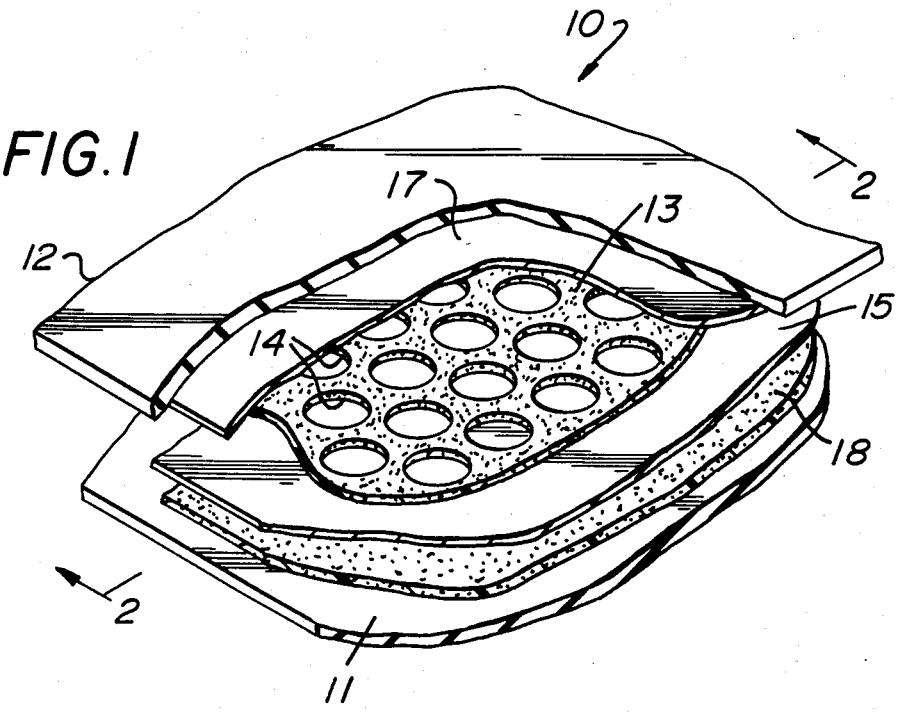
FIG. 2
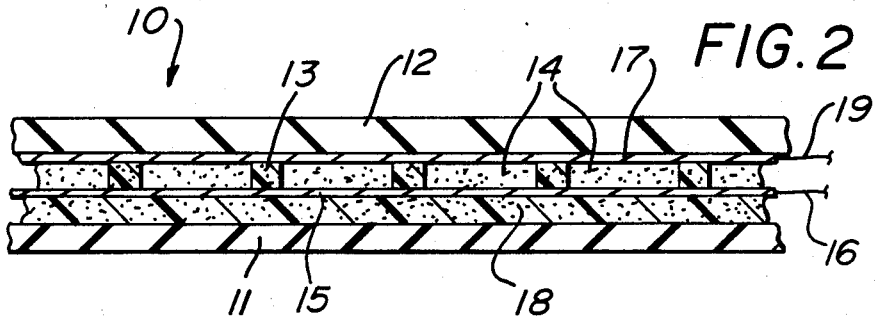
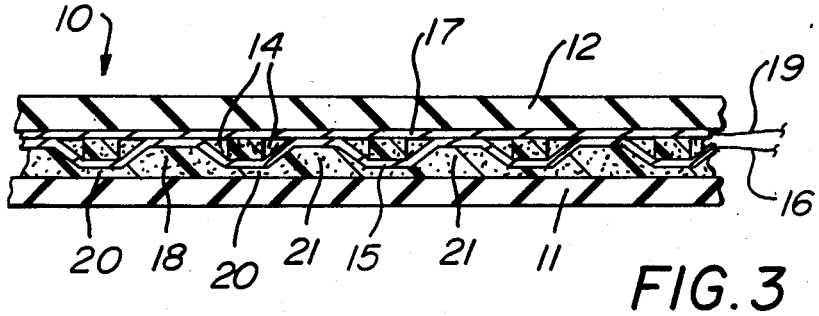
FIG. 3

HIGH SENSITIVITY MAT SWITCH

BACKGROUND OF THE INVENTION

The electric mat switch of the present invention is concerned with treadles and floor mat devices responsive to persons walking, stepping or dropping articles on the mat for closing a switch in an electric circuit. Specifically, the instant mat switch has been primarily developed and employed in association with robots, being responsive to the movement of persons or things into dangerous proximity with respect to an operating robot, to shut down the same. Of course, the instant mat switch is capable of many varied applications, all of which are intended to be comprehended herein.

Heretofore, the requirement of high sensitivity in a mat switch was incompatible with long term durability, as high sensitivity involved flexibility of parts which necessarily reduced strength and resistance to wear.

Illustrative of the prior art of which applicant is aware are the below listed patents:

| U.S. PAT. NO. | PATENTEE |
|---|---|
| 3,243,540 | Miller |
| 3,462,885 | Miller |
| 3,754,176 | Miller |
| 4,137,116 | Miller |
| 4,200,777 | Miller |
| 4,349,710 | Miller |

In prior art switches of this general type, there was required a highly localized deflection to operate the switch. Even a substantial force or weight may not have been sufficient to actuate a prior art switch, if the force or weight was distributed over a substantial area. In an attempt to obviate this problem, prior art devices often included internal protrusions for locally enhancing internal forces reacting to an external weight. This structure added to cost of materials, complexity of manufacture, and often inhibited or reduced flexibility to require additional space in shipping and storage.

SUMMARY OF THE INVENTION

It is among the important objects of the present invention to provide an electric mat switch which overcomes the above mentioned difficulties, being highly sensitive to weight or force imparted to the mat, being responsive to broadly applied forces rather than requiring highly localized force, and which permits of fabrication from substantially flat sheets for economy in manufacture, high flexibility in installation, as well as rolling for compactness in storage and shipment.

It is a more particular object of the present invention to provide a highly sensitive mat switch of a novel structure which permits of relatively stiff external materials for enhanced wear resistance without detracting from switch sensitivity.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view, broken away, showing the mat switch of the present invention.

FIG. 2 is a sectional elevational view taken generally along the line 2—2 of FIG. 1, with the mat switch in an unactuated condition.

FIG. 3 is a sectional view similar to FIG. 2, but showing the mat switch in an actuated condition.

DESCRIPTION OF THE PREFERRED EMBODIMENT

Referring now more particularly to the drawings, and specifically to FIG. 1 thereof, a mat switch of the present invention is there generally designated 10, including a pair of generally flat, lower and upper outer walls 11 and 12. The outer walls 11 and 12 may be stiff or rigid, if desired, for maximum durability, without appreciably detracting from the sensitivity of the switch 10. For many practical purposes outer walls of rubber having a hardness of 60 durometer has been found satisfactory. If desired, the outer walls 11 and 12 may be substantially rigid, such as of plywood, or other suitable material.

Interposed in spaced relation between the outer sheets or walls 11 and 12, is an intermediate, spacer sheet 13, which may be fabricated of plastic foam, such as vinyl foam. The spacer sheet 13 is perforated, as by the formation of a plurality of equally spaced and equally sized holes 14, which are preferably circular, as illustrated. The spacer layer 13 is advantageously of a relatively stiff or rigid foam material, a vinyl foam having a density of 6 pounds per cubic foot having been found satisfactory.

On opposite sides of the spacer layer or sheet 13 are a pair of conductive layers or sheets 15 and 17. The conductive sheets 15 and 17 may be of aluminum foil, preferably fabric backed, with the foil faces in confronting relation through the openings 14 of the intermediate spacer sheet 13. The conductive sheets 15 and 17 are respectively connected, as through conductors 16 and 19 to an electric circuit (not shown).

While the conductive layers 15 and 17 may be of the same highly flexible aluminum foil sheeting, the upper layer 17 need not be flexible, but may be stiff or rigid, as will appear more fully presently.

Sandwiched between the lower conductive sheet 15 and the lower outer sheet 11 is a layer or sheet of relatively highly compressible material, such as foam, being designated deflection sheet 18.

The deflection layer or sheet 18 may also be fabricated of a resiliently compressible vinyl foam material, and is of a much higher compressibility than the intermediate or spacer sheet 13. For example, a density of approximately 4 pounds per cubic foot may be satisfactory for the deflection sheet 18, so that the latter sheet is of a high resilient compressibility relative to the spacer sheet 13.

By this relationship, upon movement of the outer sheets 11 and 12 toward each other, the deflection sheet 18 is substantially compressed by the less compressible spacer sheet 13. Further, those portions of deflection sheet 18 in alignment with the perforations or holes 14 of the spacer sheet 13 are less compressed, and protrude through the holes to deflect the conductive sheet 15 through the holes into contact with the conductive sheet 17. This condition is shown in FIG. 3.

It will there be seen that the stiffer, more dense spacer sheet 13, in the regions between the holes 14, deflects or depresses the opposite portions of flexible conductor sheet 15 and the lower deflection sheet 18, as in the regions 20. The remaining portions of the deflection sheet 18, as at 21, are not deflected, but rather, protrude through the holes 14 of the spacer sheet 13 to place the confronting regions of conductive sheets 15 and 17 in facing engagement with each other, to close the electrical circuit of the mat switch 10.

It will be seen that the outer sheets 11 and 12 may move toward each other in substantial parallelism to effect this switch closing action. That is, there is not required a localized area of relatively high force to insure switch closure. Rather, the lower outer sheet 11 may rest on the rigid floor, and the upper outer sheet 12 may be substantially rigid, or a rigid cover or board may overlay the upper outer sheet 12, all without detracting from the sensitivity of the mat switch 10.

The relationship of compressibility of foam layers 13 and 18 is critical, in that the foam layer 18 must have a compressibility of at least 50% more than that of foam layer 13. That is, the density of foam layer 13 must be at least 50% greater than that of foam layer 18. Indeed, the sensitivity of the instant switch may be considered as proportional to the ratio of spacer density to deflection sheet density.

In prior art devices of this type, it was necessary to use perforations 14 of relatively large size, which rapidly led to permanent deformation with the conductive sheets 15 and 17 in contact through a spacer opening. By the instant invention the openings 14 may be made much smaller so that resilient protrusion to engage confronting portions of conductive sheets is effected with high sensitivity, and without the danger of rapid deformation or sagging of the conductor sheets into permanent contact.

From the foregoing, it is seen that the present invention provides a high sensitivity mat switch which is adapted to be fabricated of relatively stiff or rigid outer sheets for extreme durability, while affording a high degree of sensitivity responsive to forces without localized highs, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A high sensitivity mat switch for response to low unit pressure over a broad area and comprising a pair of substantially imperforate broad outer sheets in general parallelism, said outer sheets being relatively rigid for high durability, a resilient compressible open work spacer sheet having a multiplicity of through openings and located between said outer sheets, a resiliently compressible substantially imperforate deflection sheet located between said spacer sheet and one outer sheet, said spacer sheet being compressible and said deflection sheet being elastically deformable into and substantially through multiple openings in said spacer sheet under relatively low compressive force applied to an area of said outer sheets overlying the multiple openings, a first conductive sheet between and engaging said spacer sheet and the other outer sheet, and a second relatively flexible conductive sheet between and engaging said spacer sheet and said deflection sheet in spaced confronting relation with said first conductive sheet through said multiplicity of openings in the absence of said compressive force, said second conductive sheet being relatively flexible and deflectible with said deflection sheet into said multiple openings to contact said first conductive sheet at a plurality of locations under relatively low compressive force applied to said area of said outer sheets, said outer sheets being more rigid than said deflection sheet and said second flexible conductor sheet.

2. A high sensitivity mat switch according to claim 1, said second conductive sheet being of aluminum foil.

3. A high sensitivity mat switch according to claim 1, said deflection sheet being of foam.

4. A high sensitivity mat switch according to claim 1, said deflection sheet having an elastic compressibility of about twice that of said spacer sheet to insure sensitivity under a wide range of conditions.

5. A high sensitivity mat switch according to claim 1, said deflection and spacer sheets being fabricated of foam.

6. A high sensitivity switch according claim 5, the foam of said deflection sheet having an elastic compressibility of at least 1.5 times that of the foam of said spacer sheet.

7. A high sensitivity mat switch according to claim 1, the compressibility of said deflection sheet being sufficiently greater than that of said spacer sheet for resilient protrusion of the former sheet through the latter sheet to contact said conductive sheets upon movement of said outer sheets in parallelism toward each other.

8. A high sensitivity mat switch according to claim 1, said open work spacer sheet having openings sufficiently small for resilient protrusion of said deflection sheet without permanent deformation of said conductive sheets into contact.

9. A high sensitivity mat switch according to claim 8, said sheets all being substantially flat in undistended condition.

* * * * *